United States Patent [19]

Takeuchi et al.

[11] Patent Number: 4,620,882

[45] Date of Patent: Nov. 4, 1986

[54] PROCESS FOR CONTINUOUSLY COLORING STAINLESS STEEL

[75] Inventors: Takeshi Takeuchi; Hideo Kaito, both of Chiba, Japan

[73] Assignee: Nisshin Steel Co., Ltd., Tokyo, Japan

[21] Appl. No.: 711,538

[22] PCT Filed: Jul. 10, 1984

[86] PCT No.: PCT/JP84/00353

§ 371 Date: Feb. 28, 1985

§ 102(e) Date: Feb. 28, 1985

[87] PCT Pub. No.: WO85/00388

PCT Pub. Date: Jan. 31, 1985

[30] Foreign Application Priority Data

Jul. 11, 1983 [JP] Japan ..... 58-124845

[51] Int. Cl.[4] ..... C23C 22/24

[52] U.S. Cl. ..... 148/6.2; 148/6.21; 204/1 T

[58] Field of Search ..... 204/1 R, 1 T, 400, 401, 204/412, 434, 28, 206; 148/6.2, 6.21, 6.24, 129

[56] References Cited

U.S. PATENT DOCUMENTS

| | | | |
|---|---|---|---|
| 3,808,393 | 4/1974 | Goodwin et al. | 219/97 |
| 3,839,096 | 10/1974 | Skedgell et al. | 148/6.2 |
| 3,916,140 | 10/1975 | Clews | 219/100 |
| 4,026,737 | 5/1977 | Takahari et al. | 148/6.2 X |
| 4,133,922 | 1/1979 | Ensanian | 204/1 T |
| 4,269,633 | 5/1981 | Takeuchi et al. | 148/6.21 |
| 4,370,210 | 1/1983 | Yoshihara et al. | 204/1 T X |

FOREIGN PATENT DOCUMENTS 58-25747 5/1983 Japan .

*Primary Examiner*—John F. Niebling
*Assistant Examiner*—Nam X. Nguyen
*Attorney, Agent, or Firm*—Wenderoth, Lind & Ponack

[57] ABSTRACT

A continuous process for coloring a stainless steel strip by continuously causing the strip to pass through a coloring solution wherein a potential difference between the steel of the strip and a reference electrode in the coloring solution is monitored regarding at least two positions where the strip is caused to pass, at least a part of the length of immersion of the strip in the coloring solution being present between the two positions; and processing conditions are controlled so that a variation in the difference between the monitored potential differences may be suppressed.

8 Claims, 8 Drawing Figures

PROCESS FOR CONTINUOUSLY COLORING STAINLESS STEEL

FIELD OF THE INVENTION

The present invention relates to a process for continuously coloring stainless steel, in which surfaces of the stainless steel are colored by continuously causing a strip of the stainless steel to unidirectionally pass through a coloring solution at a certain velocity. More particularly it relates to a process for continuously coloring a strip of stainless steel by the above-mentioned continuous procedure, which process may achieve uniform coloring, irrespective of inevitable changes with time of the composition and concentration of the coloring solution during the procedure.

BACKGROUND OF THE INVENTION

Well known in the art are chemical processes for coloring stainless steel using a coloring aqueous solution of so-called chromic acid-sulfuric acid series, including, for example, chromic anhydride-sulfuric acid series, sodium bichromate-sulfuric acid series and potassium bichromate-sulfuric acid series. Preferred examples of such coloring solutions are disclosed in UK Patent specifications Nos. 1,122,172 and 1,122,173. When stainless steel is immersed in such a coloring solution colors of various shades may develop on the surfaces of the stainless steel depending upon the time of immersion. This is because, although related to the composition of the steel, depending upon the extent and state of oxide films formed on the surfaces of the steel by particular redox reactions the color shade thereof varies. This variation of the color shade appears continuously. Accordingly, it is possible to develop a color of the predetermined shade by controlling the time of immersion (the processing time). A convenient method for controlling the color shade is disclosed in Japanese Patent Post-examination Publication No. 52-25,817. The principle underlying the disclosed method is such that the difference between the potential of the steel, which is immersed in the coloring solution and on which oxide films are being formed, and the potential of a reference electrode disposed in the coloring solution varies in accordance with the extent of the oxide films being formed on the steel, i.e. in accordance with the color shade, and therefore the color shade may be controlled by measuring and using the above-mentioned potential difference as a measure. Thus, if an article of stainless steel immersed in a coloring solution is taken out of the solution when the above-mentioned potential difference has reached a predetermined value, a colored article having a shade which corresponds to the potential difference value may be obtained. This method in which the potential difference is utilized as a measure for controlling the color shade is very useful when the coloring process is carried out batchwise. In fact when a stainless steel article to be colored is immersed batchwise in a coloring solution, coloring proceeds substantially uniformly over the whole surfaces of the article, and in consequence, if the immersed article is taken out of the coloring solution at the time the potential difference has reached the value corresponding to the desired color shade, it is possible to achieve the substantially same color shade over the whole surfaces of the article.

If uniform coloring can be realized by a continuous procedure, the productivity of the coloring process will be greatly increased. It would be very advantageous if it is possible to develop a certain predetermined color over the whole surfaces of a stainless steel strip, for example, by causing the strip to continuously pass through a coloring solution. More particularly, it is desired to color a stainless steel strip uniformly over the whole length of the strip by providing a vessel containing a coloring solution between a pay-off roll and a wind-up roll and continuously moving the stainless steel strip so that the strip unwound from the pay-off roll may be caused to pass through the vessel and wound up by the wind-up roll while forming colored coatings thereon during its passage through the coloring solution in the vessel.

However, with such a continuous procedure the state of the colored coating being formed on the strip passing through the coloring solution varies continuously from the initial state immediately after the strip is immersed in the coloring solution, at which state substantially no colored coating is formed, to the final state immediately before the strip is taken out of the coloring solution, at which state the colored coating has grown to a certain thickness. Accordingly, even if a potential difference between the moving strip at a selected position and a reference electrode located in the coloring solution is measured, the measured value will be affected by the varying states of the colored coating which extends in front and rear of the selected position, and will not precisely reflect the state of the colored coating at the selected position. In other words, it is unreasonable to utilize the above-mentioned measured potential difference as such as a detected signal for controlling the state of the formed colored coating. By way of an example, let us suppose that a suitable contact means for detecting a potential is fixedly mounted so that the steel of the strip may come in contact with said means immediately before the strip leaves the coloring solution, and the potential difference is measured between the steel in contact with said means and a reference electrode located in the coloring solution. The measured value however does not solely correspond to the colored coating formed on that portion of the strip which is going to leave the coloring solution (the colored coating at the detecting position), rather the value is influenced by the colored coating formed on broad areas of the strip which extends from the detecting position into the coloring solution (the nature of the colored coating gradually varies depending upon the distance from the detecting position).

In addition, with the continuous procedure, the composition of the coloring solution and the concentrations of ingredients thereof inevitably vary with time as the process is continued. As the process proceeds the concentration of $Fe^{3+}$ resulting from the redox reaction involved as well as the proportions of $Cr^{3+}$ and $Cr^{6+}$ in the coloring solution vary. Furthermore, loss of water due to evaporation occurs, since the process is normally carried out at an elevated temperature. It is practically impossible to maintain the composition and concentrations of the coloring solution always constant during the continuous procedure. Fresh surfaces of a stainless steel strip are successively introduced into the coloring solution which is gradually varying with time, and thus the colored coating formed on the strip is also influenced by the variation of the coloring solution.

The problems discussed above are peculiar to the continuous procedure. The batch procedure is not accompanied by such problems. In the batch procedure the colored coating of substantially the same thickness grow similarly anywhere of the surfaces of an article to be colored, and all portions of the surfaces of the article contact with the coloring solution of the same composition and concentrations at anytime irrespective of the variation with time of the composition and concentrations of the coloring solution.

Japanese Patent Post-examination Publication No. 58-25747 discloses a proposal for solving the above-mentioned problems involved in the continuous procedure. According to this publication, as a surface to be colored is moved, the coloring solution is also moved at the same velocity. However, such a proposal requires an apparatus of a larger scale, and does not yet ensure that the composition and concentrations of the coloring solution may be always maintained constant as the process proceeds. Japanese Patent Post-examination Publication No. 56-4151 discloses a method in which the determination of the potential difference used in the batch process is as such applied to the continuous process, that is a method in which a potential difference between a continuously running stainless steel strip and a reference electrode disposed in a coloring solution is measured. More particularly, a potential difference between the steel of the strip passing over a certain point and the reference electrode is measured and is utilized for controlling the formation of colored coating. However, color control can not be exactly carried out by such a method for the reasons discussed above and as illustrated hereinafter in control examples. Japanese Patent Laid-open Publication No. 58-167778 proposes a method in which the color phase instead of any potential difference is utilized as a measure for controlling a continuous process of coloring a stainless steel strip. However, the determination of the continuously varying color phase poses a problem in the precision of the measurement.

DISCLOSURE OF THE INVENTION

An object of the invention is to solve the above-mentioned problems involved in a continuous process for coloring a stainless steel strip. More particularly, it is to provide a method for precisely measuring the state (and in turn the color shade) of the colored coating being formed on surfaces of a stainless steel strip continuously moving through a coloring solution, irrespective of the fact that the state of the colored coating being formed on the surfaces of the submerged strip at a given instant varies from place to place and, the composition and concentrations of the coloring solution vary as the process proceeds.

Another object of the invention is to establish a continuous process for coloring a stainless steel strip wherein the state of the colored coating being formed on surfaces of a stainless steel strip being continuously processed is measured without being affected by the above-mentioned varying factors, and wherein processing conditions are controlled based on the measured value so that the desired uniform coloring may be achieved.

According to the invention there is provided a process for continuously coloring a stainless steel wherein a strip of the stainless steel is continuously caused to unidirectionally move along its longitudinal direction at a certain velocity and to pass through a coloring solution of chromic acid-sulfuric acid series with a certain length of immersion in said coloring solution, characterized by selecting at least a pair of longitudinally spaced detecting positions where the strip is caused to pass, at least a part of said length of immersion being present between said detecting positions;

monitoring a first potential difference between the steel of the strip passing over the first detecting position and a reference electrode immersed in the coloring solution and a second potential difference between the steel of the strip passing over the second detecting position and a reference electrode immersed in the coloring solution; and controlling at least one of the temperature of the coloring solution and the time taken for the strip to pass through the coloring solution so that the variation with time of the difference between the first and second potential differences may be minimized.

In the practice of the invention the unidirectional movement of the stainless steel strip is carried out preferably by winding up the strip unwound from a pay-off roll on a wind up roll, and the immersion of a certain length of the strip in the coloring solution is carried out preferably by causing the unidirectionally moving strip to continuously pass through a vessel of the coloring solution placed between said rolls. The coloring solution of chromic acid-sulfuric acid series referred herein includes aqueous solutions of so-called chromic acid-sulfuric acid series, such as those of chromic anhydride-sulfuric acid series, sodium bichromate-sulfuric acid series and patassium bichromate-sulfuric acid series. Such aqueous coloring solutions of chromic acid-sulfuric acid series (briefly referred to herein as coloring solutions) are well-known and may react with stainless steel to cause redox reactions whereby colored coatings of various color shades may be formed on the surfaces of the steel. As the above-mentioned measuring (detecting) positions, more than two positions may be selected. In other words, two or more pairs of detecting positions may be selected, and for each pair the difference between potential differences may be detected. In this case a certain detecting position may be common to the different pairs. The length of the strip brought in contact with the coloring solution between the selected detecting positions should preferably be at least one fifth of the total length of the strip immersed in the coloring solution. The time taken for the strip to pass through the coloring solution may be conveniently controlled by adjusting either the moving velocity of the strip or the length of the strip immersed in the coloring solution. The temperature of the coloring solution may be controlled by adjusting the heat quantity externally supplied to the coloring solution.

DETAILED DESCRIPTION OF THE INVENTION

With reference to the drawings the invention will now be specifically described.

Figure 1:
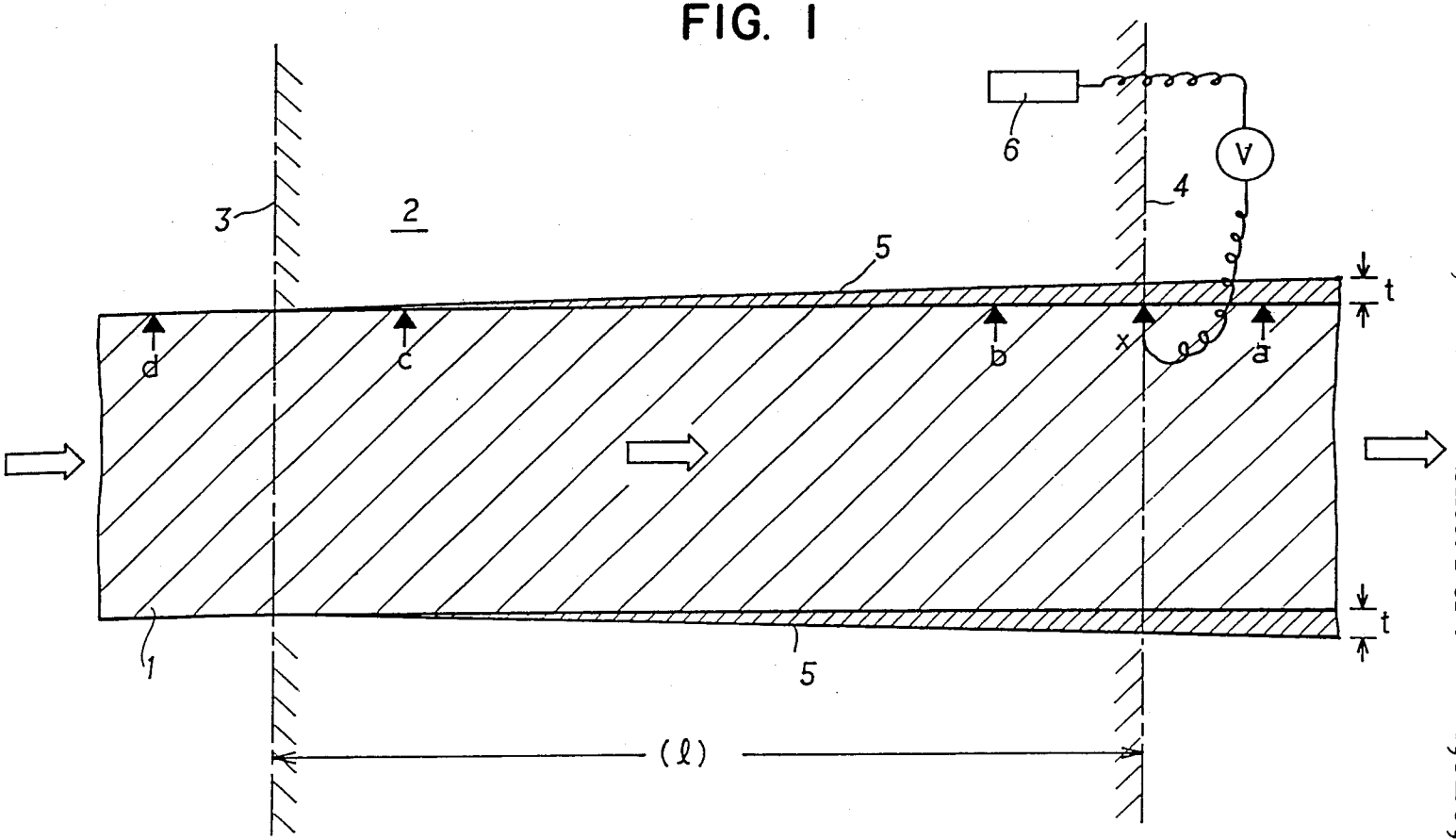
FIG. 1 is a conceptional view of a stainless steel strip being colored for illustrating the principle of the process according to the invention.

FIG. 1 is a conceptional view of a stainless steel strip 1 which is continuously caused to pass through a zone of a coloring solution 2 (hereinafter referred to as a coloring zone). In the figure the length of immersion l is shown on a considerably reduced scale. Let us suppose that the coloring zone 2 is stationary while the strip 1 only continuously moves through the coloring zone at a certain constant velocity. As the strip 1 travels from a start line 3 of immersion to a final line 4 of immersion, colored coatings 5 gradually grow on the surfaces of the strip 1, eventually to a thickness of t. It is desired but practically impossible to determine a potential corresponding to the thickness t. By the way of an example a potential difference between the steel of the strip at the finish line 4 (detecting position x shown in the figure) and a reference electrode 6 immersed in the coloring zone may be measured. However, because redox reactions are occurring over wide areas of the surfaces of the strip extending from this position x into the coloring zone 2 with varying potentials and thicknesses of the colored coating in the areas, the measured value of the potential difference is that affected by the whole areas and does not correspond to the thickness t. The same can be said to the cases wherein detecting positions a through d shown in FIG. 1 are selected. Determination of the potential difference is possible at positions such as a and d outside the coloring zone 2, since the strip in itself is electrically conductive. The value of the potential difference measured at position a or d is affected by reacting surfaces of the strip which extends from the finish or start line 4 or 3 into the coloring solution. Likewise the value of the potential difference measured at position b or c is affected by reacting surfaces of the strip which extends forward and backward from that position.

Additionally, in the practice of the continuous process, the composition, concentrations, quantity ahd temperature of the coloring solution, and in turn the length of immersion inevitally vary as the process proceeds (since the reaction products are continuously removed from the reaction system, the reaction system in itself inevitally varies with time), and such changes of the reaction system with time cause the measured potential difference to vary. Accordingly, precise control of the process will not be ensured by the determination of a potential difference between the steel of the moving strip passing over a certain position (which is stationary) and a reference electrode 6 in the coloring solution and the adoption of the determined potential difference as a signal for controlling the colored coating being formed.

It has now been found that if the potential difference between the steel strip and the reference electrode is measured at two different positions, the difference between the measured potential differences can be utilized as a signal for precisely controlling the thickness of the colored coating and in turn the color shade of the colored coating.

Figure 2:
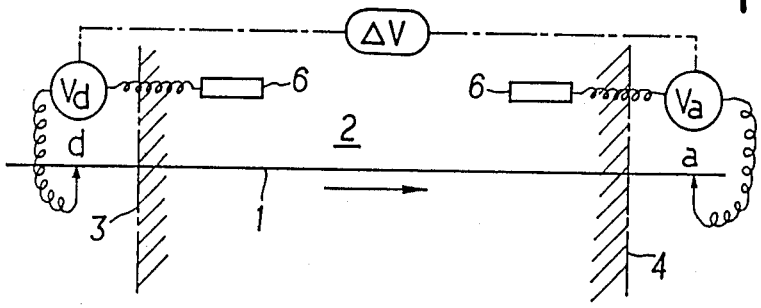
FIG. 2 is a diagrammatic view showing an example of selecting a pair of detecting positions in accordance with the invention.

FIGS. 2–5 diagrammatically show various typical embodiments wherein the potential difference is measured at two positions. FIG. 2 shows an example wherein one of the detecting positions is located at a, after the strip 1 leaves the coloring zone 2, and the other of the detecting positions is located at d, before the strip 1 enters the coloring zone 2. The steel base of the strip passing over each detecting position is bought in contact with a contact terminal, which will be described hereinafter in detail. The contact terminal itself is substantially stationary (the same is said to examples shown in FIGS. 3–5). In an example shown in FIG. 2, the potential difference Va between the steel of the strip 1 passing over the position a and the reference electrode 6 is monitored. At the same time, the potential difference Vd between the steel of the strip 1 passing over the position d and the reference electrode is also monitored. We have found that the difference $\Delta V$ between the measured potential differences Va and Vd can be a really precise signal indicating the surface behavior of the strip at the time of monitoring. It is believed that the above-mentioned undeterminable factors affecting individual potential differences Va and Vb, such as variations of the state of the colored coating over wide areas and varying parameters of the coloring solution, may be eliminated by taking the difference $\Delta V$ between the potential differences Va and Vd. It should be appreciated that since the strip itself is electrically conductive, the fact that the detecting positions are outside the coloring zone 2, as is the case with an example shown in FIG. 2, does not disturb the measurement unless the distance between each detecting position and the coloring zone 2 varies to a great extent during the measurement.

Figure 3:
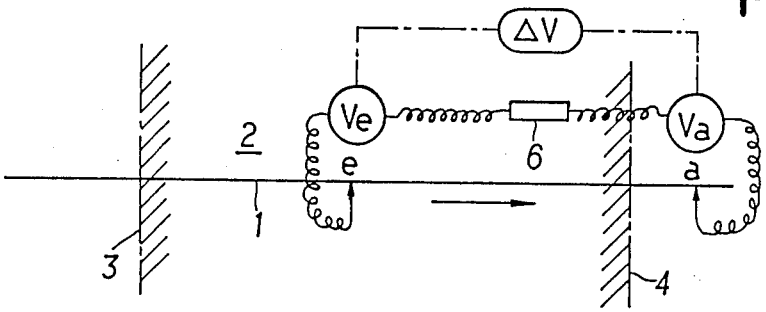
FIG. 3 is a diagrammatic view showing another example of selecting a pair of detecting positions in accordance with the invention.
Figure 4:
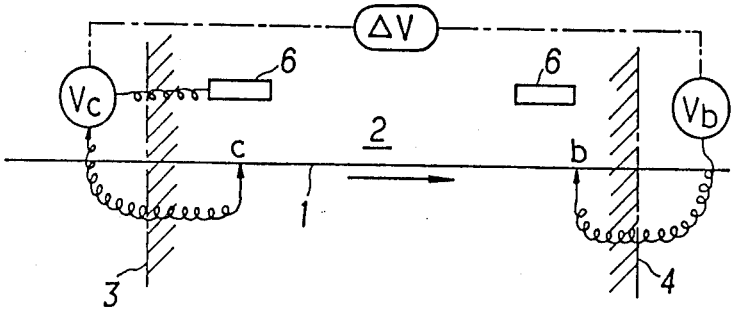
FIG. 4 is a diagrammatic view showing a further example of selecting a pair of detecting positions in accordance with the invention.
Figure 5:
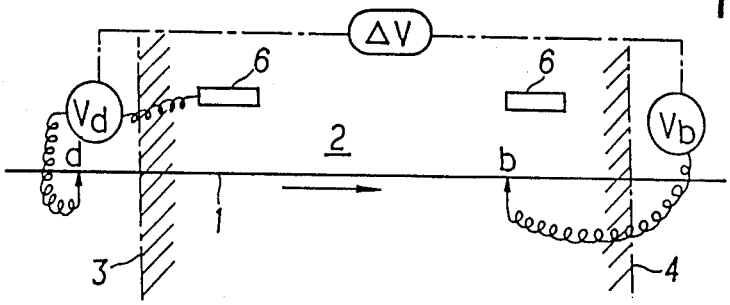
FIG. 5 is a diagrammatic view showing a still further example of selecting a pair of detecting positions in accordance with the invention.

FIG. 3 shows an example wherein one of the detecting position a is at a location as shown in FIG. 2, while the other detecting position e is in the coloring zone 2. FIG. 4 shows an example wherein both the detecting positions b and c are in the coloring zone 2. FIG. 5 shows an example wherein one of the detecting position d is at a location as shown in FIG. 2, while the other detecting position b is in the coloring solution. In each case of examples shown in FIGS. 3–5, as is the case of the example shown in FIG. 2, a first potential difference Vi between the steel of the strip 1 passing over one of the detecting positions and a reference electrode 6 and a second potential difference Vj between the steel of the strip 1 passing over the other detecting position and a reference electrode 6 are measured, and the difference $\Delta V$ between the first and second potential differences Vi and Vj is detected. The difference $\Delta V$ so detected may vary depending upon a particular combination of the selected detecting positions. Nevertheless, it provides in each example a precise signal indicating the surface behavior of the strip at the time of monitoring, with influences of undeterminable factors affecting individual potential differences, such as varations of the state of the colored coating over wide areas and varying parameters of the coloring solution, being eliminated. The examples for selecting a pair of detecting positions may be combined. In other words, two or more pairs of detecting positions may be selected and two or more $\Delta V$ values may be detected to obtain two or more control signals. The more the control signals the more precisely the process may be controlled. If desired one and the same reference electrode may be used commonly to two or more detecting positions.

One or both of the selected detecting positions may be located either outside the coloring zone 2 or in the coloring zone 2. It is essential, however, that at least a part of the length of immersion of the strip must be present between the detecting positions. It is preferred that at least one fifth of the total length of immersion of the strip is immersed in the coloring solution between the first and second detecting positions. For example, the path length of the strip 1, e-4 (shown in FIG. 3), c-b (shown in FIG. 4) and 3-b (shown in FIG. 5), should preferably be not shorter than one fifth of the total length of immersion l (that is the path length of the strip 1 from the start line of immersion 3 to the finish line of immersion 4). If the length of immersion of the strip between the selected detecting positions is unduly short, the detected difference between the potential differences will become too small to provide a sensitive control signal.

Figure 6:
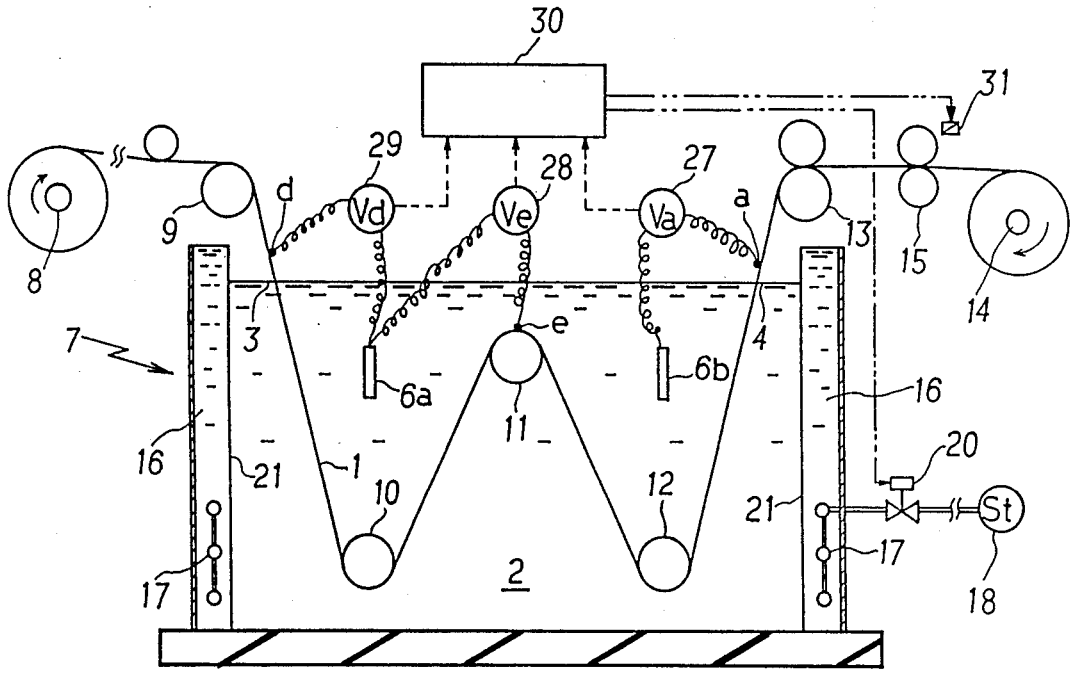
FIG. 6 is a schematic vertical cross-section of an apparatus suitable for use in carrying out the process according to the invention.

FIG. 6 is a schematic vertical cross-section of an apparatus suitable for use in carrying out the process according to the invention. As shown in FIG. 6, a strip 1 of stainless steel is caused to pass through a coloring solution 2 contained in a vessel 7. More particularly, the strip 1 is unwound from a pay-off roll 8, guided by rolls 9, 10, 11, 12 and 13 so that it takes a path passing through the coloring solution 2, and coiled by a coiler or wind up roll 14.

The length l of immersion of the strip 1 in the coloring solution is the length of path of the strip 1 from the start line 3 of immersion to the finish line 4 of immersion. This length l may be adjusted either by vertically moving rolls disposed in the vessel, for example, roll 11, or by changing the positions of rolls disposed outside the vessel such as rolls 9 and 13 along the longitudinal direction of the vessel, thereby changing inclinations of the strip passing through the coloring solution 2. Such control of the length of immersion by adjusting the positions of the rolls, and in turn control of the time taken for the strip 1 to pass through the coloring solution may be carried out even when the apparatus is operating. Control of the time taken for the strip 1 to pass through the coloring solution 2 may also be carried out by controlling the velocity of movement of the strip 1. This may be done by controlling the coiling speed of the strip, more specifically by adjusting the number of rotation of a tension rolls 15 mounted near the coiler 14. This adjustment of the number of rotation may carried out by control of the number of rotation of an electric motor, which drives the tension rolls 15, and for the purpose of controlling the number of rotation of the driving motor a well-known inverter system may be utilized.

The vessel 7 has a construction of double peripheral walls, with a heating liquid 16 sealed between the walls. A heat exchange coil 17 is installed between the walls, and a heating medium such as steam is supplied to the heat exchange coil 17 from a heat source 18 outside the system via a heat supply pipe equipped with an electromagnetic valve 20. By on-off control of the electromagnetic valve 20, an amount of the heating medium supplied to the heat exchange coil 17, and in turn the temperature of the liquid 16 may be adjusted. Heat of the liquid 16 is then conducted through an inner wall 21 made of a heat conductive material to the coloring solution 2 contained in the vessel 7, whereby the temperature of the coloring solution is adjusted.

Upon carrying out the process according to the invention using an apparatus equipped with, as described above, a means for adjusting the time taken for the strip 1 to pass through the coloring solution 2 and a means for adjusting the temperature of the coloring solution 2, at least a pair of detecting positions where the strip is caused to pass and which are spaced from each other longitudinally of the strip 1, are selected. The relative location of the selected pair of detecting positions may be any one of the embodiments shown in FIGS. 2–5. If desired, two or more pairs of detecting positions may be selected. In such events, one selected pair of detecting positions and another selected pair of detecting positions may be in overlapping relation. What is important is that there is at least a part (preferably at least one fifth) of the total length of immersion of the strip in the coloring solution must be present between each selected pair of detecting positions.

Figure 7:
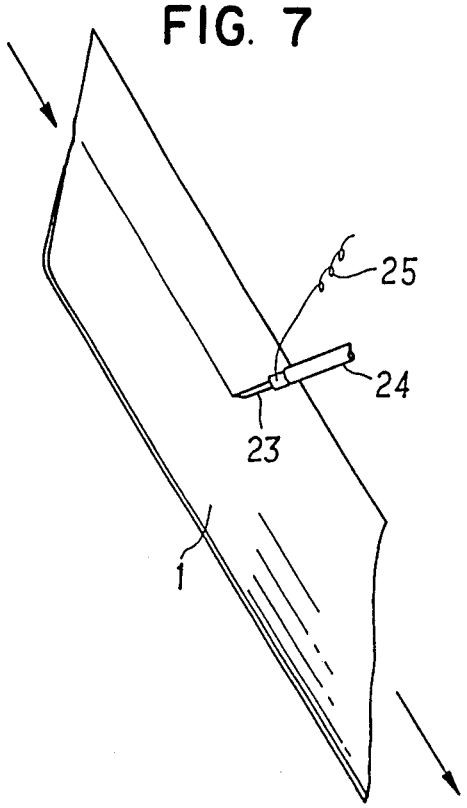
FIG. 7 is a perspective view for illustrating how to bring a detecting terminal in contact with a continuously moving steel strip.

In an example shown in FIG. 6, three pairs of detecting positions are selected. The first pair comprises a position a, where the strip 1 is caused to pass after it leaves the coloring solution 2 and before it reaches the roll 13, and a position d, where the strip 1 is caused to pass after it leaves the roll 9 and before it enters the coloring solution 2. The second pair comprises the position a, which is the same as one position of the first pair, and a position e in the coloring solution 2. The third pair comprises the position e, which is the same as one position of the second pair, and the position d, which is the same as the other position of the first pair. It will be appreciated that three pairs of detecting positions with a suitable length of immersion of the strip between each pair of positions may be obtained by suitably selecting three positions, such as a, e and d, in the manner as described above. At each detecting position, a terminal is provided for detecting the potential of the strip 1 at that position. FIG. 7 illustrates a manner of providing the detecting terminal. As shown in FIG. 7, a free end of an edge 23 made of an electrically conductive material is pressed against one of the surfaces of the running strip 1, approximately at the center of the breadth of the strip. The edge 23 is supported by a fixedly mounted supporting member 24. It is preferred that the edge 23 is supported by the supporting member 24 via a spring (not shown) so that the edge 23 may be resiliently brought in contact with the strip 1 when the supporting member 24 is fixed in position so that a certain pressure may be exerted on the strip. The edge 23 is connected to a potentiometer by means of a lead line 25. In a case, as is the case with positions a and e shown in FIG. 6, wherein the detecting terminal is to be brought in contact with the strip 1 at a position where the colored coating has been formed on the surface of the strip, the free end of the edge 23 must penetrate the colored coating and come in contact with the the steel of the strip. For this purpose the supporting member 24 must be fixed in position so that a pressing force sufficient for the free end of the edge 23 to penetrate the colored coating may be applied to the supporting member 24. In a case wherein the detecting terminal is immersed in the coloring solution 2, any potential difference between the metal of the terminal and the coloring solution 2 might provides an external perturbation, and therefore those portions of the edge 23 and lead line 25, which are immersed in the coloring solution, should preferably be constructed from a material such as platinum and titanium. In a case wherein the terminal is not immersed in the coloring solution 2, as is the case with the position a and d, the terminal may be constructed from an ordinary conductive material, such as copper and steel.

Reference electrodes 6 are provided in the coloring solution 2. While any electrodes normally used for measuring a potential of metal are suitable as the reference electrode, calomel and platinum electrodes are preferred. Use of a platinum electrode is particularly preferred from a view point of practical operation. When two or more pairs of detecting positions are selected, as is the case with an example shown in FIG. 6, the number of reference electrodes to be provided does not necessarily corresponds the number of the selected pairs, and thus one reference electrode may be used commonly to different pairs of detecting positions. In an example shown in FIG. 6, the presence of the roll 11 makes it difficult to build up circuits so that one reference electrode may be used commonly to all the selected pairs of detecting positions, and thus two reference electrodes 6*a* and 6*b* are provided in the coloring solution 2. In any event, a potential difference between the steel of the strip 1 passing over each of the selected detecting positions and one of the reference electrodes are monitored and the difference between the potentical differences is detected for each selected pair of detecting positions. In an example shown in FIG. 6, there are monitored during the coloring process, the difference (Va−Vd) between the potential differences Va and Vd, for a first selected pair of detecting positions a and d, the Va being the potential difference between the steel of the strip passing over the position a and the reference electrode 6*b*, while the Vd is the potential difference between the steel of the strip passing over the position d and the reference electrode 6*a;* the difference (Va−Ve) between the potential differences Va and Ve, for a second selected pair of detecting positions a and e, the Va being the potential difference between the steel of the strip passing over the position a and the reference electrode 6*b*, while the Ve is the potential difference between the steel of the strip passing over the position e and the reference electrode 6*a;* and, the difference (Ve−Vd) between the potential differences Ve and Vd, for a third selected pair of detecting positions e and d, the Ve being the potential difference of the steel of the strip passing over the position e and the reference electrode 6*a*, while the Vd is the potential difference between the steel of the strip passing over the position d and the reference electrode 6*a*.

Figure 8:
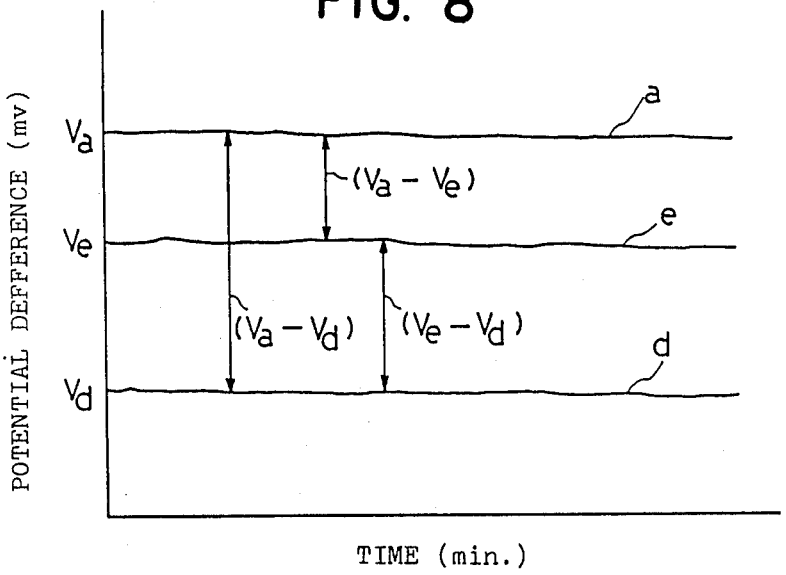
FIG. 8 is a graph for illustrating the change with time of the potential difference between the steel of the strip and the reference electrode detected at each of the selected three positions as well as the change with time of the difference between each two of these three detected potential differences.

FIG. 8 graphically shows these difference of potential differences (Va−Vd), (Va−Ve) and (Ve−Vd). In FIG. 8, the potential difference Va between the steel of the strip passing over the position a and the reference electrode 6*b*, the potential difference Ve between the steel of the strip passing over the position e and the reference electrode 6*a*, and the potential difference Vd between the steel of the strip passing over the position d and the reference electrode 6*a* a change with time as the process proceeds, if processing conditions are not controlled.

Upon carrying out the process according to the invention, the potential differences Va, Ve and Vd may be detected by means of potentiometers 27, 28 and 29, respectively, as shown in FIG. 6, and the detected potential differences are put in a controller 30 having a computer installed therein as electric signals. The computer in the controller 30 calculates one or more of the required differences of potential differences (Va−Vd), (Va−Ve) and (Ve−Vd) from the potential differences Va, Ve and Vd, and when at least one of the calculated differences of potential differences exceeds a predetermined threshold value, put out a control signal to means for adjusting processing conditicns. As described hereinbefore, the apparatus shown in FIG. 6 is provided with means for adjusting the time taken for the strip 1 to pass through the coloring solution 2 and means for adjusting the temperature of the coloring solution 2. When at least one of the differences of potential differences exceeds the threshold value, control signals for adjusting one or both of the above-mentioned means are put out so as to return the difference(s) of potential differences within the range required by the threshold values. More specifically, the control signals are put out to the inverter unit 31 for controlling the number of rotation of the electric motor of the tension roll 15, which is the means for adjusting the time taken for the strip 1 to pass through the coloring solution 2, and/or to an opening degree adjuster of the electro-magnetic valve 20 for adjusting the temperature of the coloring solution, whereby the detected difference(s) of potential differences may fall within the required range(s). The programming in itself for putting out the control signals from the input signals of the detected difference(s) of potential differences, will be readily dealt with by a person skilled in the art by a known programming technique using the difference(s) of potential differences detected in the manner as prescribed herein. When a product of a particular color shade is desired, the relation between the particular color shade and the difference(s) of potential differences is preliminarily studied, and based on the stock of information preliminarily studied, the value(s) of the difference(s) of potential differences for obtaining the particular colore shade may be selected in accordance with a conventional programming technique.

Thus, according to the invention one or both of the time taken for the strip to pass through the coloring solution and the temperature of the coloring solution are controlled in accordance with the detected difference(s) of potential differences so that the change with time of the difference(s) of potential differences may be suppressed, whereby uniform coloring of the desired color shade may be continuously achieved. The colored stainless steel strip 1 is washed with water, and then preferably subjected to an electrolytic treatment using a mixed aqueous solution of chromic acid and phospharic acid to harden the colored coatings.

EXAMPLE 1

Using an apparatus with parts and instruments arranged as shown FIG. 6, a BA (Bright Annealing) finished strip of SUS 304 stainless steel was colored in gold. The aqueous coloring solution used contained 500 g/l of sulfuric acid and 250 g/l of chromic acid at the beginning of the coloring process. During the process, the concentrations of the ingredients of the coloring solution were not adjusted intentionally. The temperature of the coloring solution was maintained within the range of 82°±2° C. during the process. The strip was caused to continuously pass through the coloring solution with a length of immersion of 400 cm. Two positions d and a, shown in FIG. 6, were selected to detect the potential differences and the difference between them.

Prior to the actual process, a preliminary test was carried out to know the value of the difference of potential differences at the time the strip leaving the coloring vessel has colored coatings of the desired gold color. The test revealed that the difference of potential differences to achieve the desired gold color was 8.2 mv. More particularly, the preliminary test was carried out using substantially the same conditions as mentioned above regarding the actual coloring process. When the desired gold color was obtained in the preliminary test, the potential difference between the steel and reference electrode was measured at the positions d and a (Measuring of the potential difference at each detecting position was carried out in the preliminary test as well as in the actual process in the manner as described above with reference to FIG. 7, that is by bringing the edge 23 in contact with the steel of the strip passing over the detecting position). The measured values were −194.5 mv (at the position d) and −186.3 mv (at the position a). The line speed at that time was 40 m/min.

The actual coloring process was continuously carried out for a period of one hour, in which the difference between the potential differences measured in the preliminary test, i.e.

$$|(-194.5\text{ mv})-(-186.3\text{ mv})|=8.2\text{ mv}$$

was used as the studied value, and the line speed was controlled during the processing period so that the difference between the detected potential differences might fall within the range between 8.2±0.1 mv. The line speed was adjusted by controlling the number of rotation of the tension roll 15, as shown in FIG. 6. More particularly, the potential differences at the detecting portions d and a were continuously monitored, and the number of rotation of the tension roll 15 was decreased when the difference between the detected potential differences exceeded 8.3 mv, while the number of rotation of the tension roll 15 was increased when the difference between the detected potentials fell down below 8.1 mv. The control was performed by means of a computer.

Measuring positions were selected on the colored stainless steel with an interval of 1 m over a longitudinal length of about 24 m, and the color difference ΔE between adjacent measuring positions was determined in accordance with "Method for Measuring Colored Body at Visual Field of 2 degrees" as prescribed in JIS Z-8722. The color was indicated in accordance with a method for indicating color difference prescribed in JIS Z-8730. The instrument used was a color analyser supplied by Hitach Works Company Ltd. All the measured values of the color difference were less than 0.3, indicating the fact that the stainless steel strip has been colored uniformly over the whole length.

COMPARATIVE EXAMPLE 1

A continuous coloring process was carried out for one hour using the conditions described in Example 1 except that the line speed of 40 cm/min., with which the gold color had been achieved in the preliminary experiment, was always maintained without using the difference between potential differences detected at the two positions as a control signal. The colored stainless strip so obtained was measured for the color difference ΔE in the manner as described in Example 1. The color difference ΔE was about 1.0 on average. Variation in color was also visually observed.

EXAMPLE 2

A continous coloring process was carried out for one hour using the conditions described in Example 1 except that a HL (Hair Line polishing) finished strip of SUS 304 stainless steel was colored; the temperature of the coloring solution was allowed to vary in the range from about 80° C. to about 85° C.; and since the preliminary experiment had revealed that the difference between the potential differences detected at the positions d and a should be 5.3 mv for achieving gold color with this strip, the line speed was controlled so that the difference between the potential differences might be maintained in the range of 5.3±0.1 mv. The line speed was 35 cm/min. at the beginning of the process but it was controlled during the process within the range from minimum 34 cm/min. to maximum 43 cm/min. The temperature of the coloring solution was 80.1° C. at the beginning of the process but it was allowed to vary during the process in the range from 80.1° C. to 84.8° C.

The colored strip was measured for color shade and color difference ΔE in the manner as described in Example 1 except that the measurement was carried out at every 4 m. The results are shown in Table 1. In the column of Indication of Color in Table 1, "L" corresponds to brightness, "a" corresponds to relative amount of green and red, and "b" corresponds to relative amount of yellow and blue. The less variations in their values indicates the less variations in color. As seen from Table 1, the L, a and b values change little with position, and ΔE also vary little, thus indicating that sufficiently uniform coloring has been achieved.

COMPARATIVE EXAMPLE 2

A continuous coloring process was carried out using the conditions described in Example 2 except that only the potential difference between the steel at the position a and the reference electrode was monitored instead of the difference (5.3±0.1 mv) between the potential differences, and the line speed was controlled so that the potential difference at the position a might be maintained within the range of −189.3±0.1 mv since the preliminary experiment had revealed that the potential difference at the position a should be −189.3 mv for attaining gold color. The colored strip was measured for color shade and color difference ΔE in the manner as described in Example 2. The results are also shown in Table 1. As seen from Table 1, in the Comparative Example the color difference is much larger than in Example 2, and the color shade varies to a great extent in both the green-red (a value) and yellow-blue (b value) ranges.

TABLE 1

| | Measuring Position (distance in meter from one end) (m) | Indication of Color according to JISZ8730 | | | Color Difference ΔE |
|---|---|---|---|---|---|
| | | L | a | b | |
| Example 2 | 4 | 38.21 | 0.15 | 9.24 | — |
| | 8 | 38.13 | 0.21 | 9.20 | 0.11 |
| | 12 | 38.26 | 0.23 | 9.15 | 0.13 |
| | 16 | 38.18 | 0.25 | 9.13 | 0.15 |
| | 20 | 38.15 | 0.06 | 9.25 | 0.11 |
| Comparative Example 2 | 4 | 38.30 | 0.23 | 9.27 | — |
| | 8 | 38.13 | 0.13 | 9.03 | 0.31 |
| | 12 | 38.84 | −0.24 | 9.65 | 0.81 |
| | 16 | 38.66 | −0.31 | 9.82 | 0.85 |
| | 20 | 38.45 | 0.69 | 8.68 | 0.76 |

EXAMPLE 3

A continous coloring process was carried out using the conditions described in Example 1 except that four positions on the strip were selected as detecting positions. They were separated from the position at which the strip started to be immersed in the coloring solution (the position indicated in FIG. 6 by the reference numeral 3) by distances of 50 cm, 150 cm, 250 cm and 350 cm along the length of the strip. Since the detecting positions were submerged in the coloring solution, use was made of terminal members that parts (edge 23 and lead line 25 shown in FIG. 7) of which that were to be affected by the coloring solution were constructed of a titanium material. The process was continued for a period of two hours.

At the initial stage of the period there were determined differences between potential differences at adjacent detecting positions at the time the desired gold color was achieved. The results were as follows.

$V_2-V_1=3.10$ mv
$V_3-V_2=2.84$ mv
$V_4-V_3=2.81$ mv wherein $V_1$, $V_2$, $V_3$ and $V_4$ designate the potential difference between a reference electrode and the steel of the strip at the selected detecting positions in the order of the nearness to the position at which the strip starts to be immersed in the coloring solution (the position shown in FIG. 6 by the reference numeral 3). Thus, the difference between the potential differences at the remotest detecting positions was $V_4-V_1=8.15$ mv.

During the process the potential differences between the steel at respective detecting positions and the reference electrode substantially varied. But the line speed was controlled so that variations in each difference between the potential differences at adjacent detecting positions might be minimized thereby to eventually maintain $V_4-V_1=8.15$ mv constant. Thus, $V_4-V_1$ was maintained within the range of 8.15 mv 35 0.01 mv. The colored stainless steel strip so obtained was measured for the color difference in the manner as described in Example 1 with a measurement interval of 1 m. The color difference $\Delta E$ so determined was below 0.2.

We claim:

1. A process for continuously coloring a stainless steel wherein a strip of the stainless steel is continuously moved unidirectionally along its longitudinal direction at a certain velocity through a coloring solution of chromic acid-sulfuric acid series with a certain length of immersion of said strip in said coloring solution, which comprises selecting first and second longitudinally spaced detecting positions between which the strip is caused to pass, at least a part of said length of immersion being present between said detecting positions;

simultaneously monitoring a first potential difference between the steel of the strip passing over the first detecting position and a reference electrode immersed in the coloring solution, and a second potential difference between the steel of the strip passing over the second detecting position and a reference electrode immersed in the coloring solution; and controlling at least one of the temperature of the coloring solution and the time taken for the strip to pass through the coloring solution so that the variation with time of the difference between the first and second potential differences may be minimized.

2. The process in accordance with claim 1 wherein both the first and second detecting positions are outside the coloring solution.

3. The process in accordance with claim 1 wherein both the first and second detecting positions are in the coloring solution.

4. The process in accordance with claim 3 wherein at least one fifth of the length of immersion of the strip in the coloring solution is between the first and second detecting positions.

5. The process in accordance with claim 1 wherein one of the detecting positions is outside the coloring solution while the other of the detecting positions in the coloring solution.

6. The process in accordance with claim 5 wherein at least one fifth of the length of immersion of the strip in the coloring solution is between the first and second detecting positions.

7. The process in accordance with claim 1 wherein the time taken for the strip to pass through the coloring solution is controlled by adjusting the velocity of the strip.

8. The process in accordance with claim 1 wherein the time taken for the strip to pass through the coloring solution is controlled by adjusting the length of the strip immersed in the coloring solution.

* * * * *